US005447212A

United States Patent [19]

Powell

[11] Patent Number: 5,447,212

[45] Date of Patent: Sep. 5, 1995

[54] MEASUREMENT AND REDUCTION OF BUNCHING IN ELEVATOR DISPATCHING WITH MULTIPLE TERM OBJECTION FUNCTION

[75] Inventor: Bruce A. Powell, Canton, Conn.

[73] Assignee: Otis Elevator Company, Farmington, Conn.

[21] Appl. No.: 279,666

[22] Filed: Jul. 25, 1994

Related U.S. Application Data

[63] Continuation of Ser. No. 58,917, May 5, 1993, abandoned.

[51] Int. Cl.[6] ..... B66B 1/16

[52] U.S. Cl. ..... 187/382; 187/380

[58] Field of Search ..... 187/380, 382, 383, 386, 187/385

[56] References Cited

U.S. PATENT DOCUMENTS

| | | | |
|---|---|---|---|
| 3,837,436 | 9/1974 | Harasawa et al. | 187/128 |
| 4,363,381 | 12/1982 | Bittar | 187/29 |
| 4,760,896 | 8/1988 | Yamaguchi | 187/124 |
| 4,782,921 | 11/1988 | MacDonald et al. | 187/127 |
| 4,790,412 | 12/1988 | MacDonald et al. | 187/127 |
| 4,815,568 | 3/1989 | Bittar | 187/127 |
| 4,838,384 | 6/1989 | Thangavelu | 187/125 |
| 4,947,965 | 8/1990 | Kuzunuki et al. | 187/127 |
| 4,982,817 | 1/1991 | Tsuji | 187/127 |
| 5,022,497 | 6/1991 | Thangavelu | 187/124 |
| 5,024,295 | 6/1991 | Thangavelu | 187/125 |
| 5,035,302 | 7/1991 | Thangavelu | 187/125 |
| 5,146,053 | 9/1992 | Powell et al. | 187/127 |
| 5,168,136 | 12/1992 | Thangavelu et al. | 187/130 |
| 5,202,540 | 4/1993 | Auer et al. | 187/101 |

FOREIGN PATENT DOCUMENTS

| | | | |
|---|---|---|---|
| 3-51271 | 3/1991 | Japan | 187/128 |

*Primary Examiner*—Steven L. Stephan
*Assistant Examiner*—Robert Nappi

[57] ABSTRACT

To assign a car to a hall call such that cars tend to be equally spaced apart and so that bunching of cars is avoided, the position of each car is predicted over a given period by estimating where it will arrive and leave each of its committed stops over that period for a given set of hall call/car call assignments, a bunching measure is calculated and a car to hall call assignment is made in response to the bunching measure.

5 Claims, 21 Drawing Sheets

COMPARE RRT(B) TO RRT(C) TO EVALUATE THE MERIT OF CURRENT ASSIGNMENT AND TO EVALUATE IF A REASSIGNMENT TO ANOTHER CAR WOULD BE A GOOD IDEA

RRT (B | ▼9) = 6 SECS
RRT (C | ▼9) = 15 SECS

PRT (▼6 IF B IS ASSIGNED TO ▼9) = 65 SECS
PRT (▼6 IF C IS ASSIGNED TO ▼9) = 55 SECS

| CAR A | | CAR B | | CAR C | | CAR D | |
|---|---|---|---|---|---|---|---|
| TIME | FLOOR | TIME | FLOOR | TIME | FLOOR | TIME | FLOOR |
| 4 | 10↓ HC | 0 | 14↓ HC | 4 | 7↑ HC | 4 | 3↑ HC |
| 10 | 10↓ | 6 | 14↓ | 10 | 7↑ | 10 | 3↑ |
| 14 | 8↓ | 22 | 6↓ HC | 26 | 15 | 18 | 7↑ |
| 20 | 8↓ | 28 | 6↓ | | | 24 | 7↑ |
| 34 | L | 38 | L | | | 30 | 10↑ |
| | | | | | | 36 | 10↑ |
| | | | | | | 38 | 11↑ HC |

FIG. 7

| TIME→ | 5 SECS | 10 SECS | 15 SECS | 20 SECS | 25 SECS | 30 SECS |
|---|---|---|---|---|---|---|
| CAR A | 10↓ | 10↓ | 8↓ | 8↓ | 5↓ | 3↓ |
| CAR B | 14↓ | 12↓ | 9↓ | 7↓ | 6↓ | 5↓ |
| CAR C | 7↑ | 7↑ | 10↑ | 12↑ | 15 | 15 |
| CAR D | 3↑ | 3↑ | 6↑ | 7↑ | 8↑ | 10↑ |
| BUNCHING MEASURE | 234 | 262 | 282 | 270 | 252 | 250 |

$$\text{AVERAGE BUNCHING MEASURE} = \frac{234+262+282+270+252+250}{6} = 258$$

FIG. 8

| CAR A | | CAR B | | CAR C | | CAR D | |
|---|---|---|---|---|---|---|---|
| TIME | FLOOR | TIME | FLOOR | TIME | FLOOR | TIME | FLOOR |
| 2 | 11↓HC | 0 | 14↓HC | 4 | 7↑HC | 4 | 3↑HC |
| 8 | 11↓ | 6 | 14↓ | 10 | 7↑ | 10 | 3↑ |
| 10 | 10↓HC | 22 | 6↓HC | 26 | 15 | 18 | 7↑ |
| 16 | 10↓ | 28 | 6↓ | | | 24 | 7↑ |
| 20 | 8↓ | 38 | L | | | 30 | 10↑ |
| 20 | 8↓ | | | | | 36 | 10↑ |
| 40 | L↓ | | | | | 38 | 11↑HC |

FIG. 10a

| TIME→ | 5 SECS | 10 SECS | 15 SECS | 20 SECS | 25 SECS | 30 SECS |
|---|---|---|---|---|---|---|
| CAR A | 11↓ | 10↓ | 10↓ | 8↓ | 8↓ | 6↓ |
| CAR B | 14↓ | 12↓ | 9↓ | 7↓ | 6↓ | 5↓ |
| CAR C | 7↑ | 7↑ | 10↑ | 12↑ | 15 | 15 |
| CAR D | 3↑ | 3↑ | 6↑ | 7↑ | 8↑ | 10↑ |
| BUNCHING MEASURE | 250 | 262 | 286 | 270 | 246 | 276 |

$$\text{AVERAGE BUNCHING MEASURE} = \frac{250+262+286+270+246+276}{6} = 265$$

FIG. 10b

| CAR A | | CAR B | | CAR C | | CAR D | |
|---|---|---|---|---|---|---|---|
| TIME | FLOOR | TIME | FLOOR | TIME | FLOOR | TIME | FLOOR |
| 4 | 10↓ HC | 0 | 14↓ HC | 4 | 7↑ HC | 4 | 3↑ HC |
| 10 | 10↓ | 6 | 14↓ | 10 | 7↑ | 10 | 3↑ |
| 14 | 8↓ | 12 | 11↓ HC | 26 | 15 | 18 | 7↑ |
| 20 | 8↓ | 18 | 11↓ | | | 24 | 7↑ |
| 34 | L | 28 | 6↓ | | | 30 | 10↑ |
| | | 34 | 6↓ | | | 36 | 10↑ |
| | | | | | | 38 | 11↑ HC |

FIG. 11a

| TIME→ | 5 SECS | 10 SECS | 15 SECS | 20 SECS | 25 SECS | 30 SECS |
|---|---|---|---|---|---|---|
| CAR A | 10↓ | 10↓ | 8↓ | 8↓ | 5↓ | 3↓ |
| CAR B | 14↓ | 10↓ | 11↓ | 10↓ | 7↓ | 6↓ |
| CAR C | 7↑ | 7↑ | 10↑ | 12↑ | 15 | 15 |
| CAR D | 3↑ | 3↑ | 6↑ | 7↑ | 8↑ | 10↑ |
| BUNCHING MEASURE | 234 | 262 | 250 | 262 | 238 | 236 |

$$\text{AVERAGE BUNCHING MEASURE} = \frac{234+262+250+262+238+236}{6} = 247$$

FIG. 11b

| CAR A | | CAR B | | CAR C | | CAR D | |
|---|---|---|---|---|---|---|---|
| TIME | FLOOR | TIME | FLOOR | TIME | FLOOR | TIME | FLOOR |
| 4 | 32↓ | 8 | 33↓ | 14 | 39 | 30 | 30↑ |
| 10 | 32↓ | 14 | 33↓ | 20 | 39 | | |
| 12 | 31↓ HC | 50 | L | 22 | 38↓ HC | | |
| 18 | 31↓ | | | 28 | 38↓ | | |
| 20 | 30↓ HC | | | | | | |
| 26 | 30↓ | | | | | | |
| 56 | L | | | | | | |

FIG. 14a

| TIME→ | 5 SECS | 10 SECS | 15 SECS | 20 SECS | 25 SECS | 30 SECS |
|---|---|---|---|---|---|---|
| CAR A | 32↓ | 32↓ | 31↓ | 30↓ | 30↓ | U-EX↓ |
| CAR B | 35↓ | 33↓ | 33↓ | 30↓ | U-EX↓ | U-EX↓ |
| CAR C | 34↑ | 37↑ | 39 | 39 | 38↓ | 37↓ |
| CAR D | L-EX↑ | L-EX↑ | L-EX↑ | U-EX↑ | U-EX↑ | 30↑ |
| BUNCHING MEASURE | 162 | 182 | 186 | 206 | 202 | 210 |

$$\text{AVERAGE BUNCHING MEASURE} = \frac{162+182+186+206+202+210}{6} = 191$$

FIG. 14b

MEASUREMENT AND REDUCTION OF BUNCHING IN ELEVATOR DISPATCHING WITH MULTIPLE TERM OBJECTION FUNCTION

This is a continuation of application Ser. No. 08,058,917, filed on May 5, 1993, now abandoned.

TECHNICAL FIELD

The present invention relates to bunching of elevators.

BACKGROUND ART

As elevators operate in a group serving a common set of floors, the cars frequently will be close together with respect to position and direction. For instance, in a four-car group, it is not uncommon to observe three elevators traveling up in the lower portion of the building. This phenomenon is called "bunching." Bunching is defined loosely to mean that certain cars are "close together". The absence of bunching means that the cars are evenly distributed amongst the floors. Bunching is not always undesirable, as when several cars converge to a convention floor to move a large number of people. As a rule, however, bunching is undesirable. In general, a system in which the cars are evenly distributed amongst the floors will result in a minimum average waiting time for the randomly arriving passenger.

The phenomenon of bunching is illustrated in FIG. 1 which shows both Cars A and B traveling down in the top part of a 15-story building. Also, Cars C and D are reasonably close to one another. A wait-so-far time, when the hall call was registered to the present time, is shown for each hall call. The waiting time is the time from when a passenger presses a hall call button until the elevator arrives. Intuitively, a longer than desired waiting time might occur if a passenger would register a down hall call at Floor 15. The maximum waiting times could be reduced if the cars were more evenly distributed: Car A might be positioned at Floor 7-DOWN, and Car C might be positioned at floor 8-UP. With reference to FIG. 1, it can be seen that this repositioning of the cars is impossible because of the hall call and car call assignments. The impossibility of the proposed repositioning of the cars underscores the difficult nature of solving the bunching problem.

DISCLOSURE OF THE INVENTION

Objectives in the present invention include assigning an elevator car to a hall call such that elevators in an elevator group tend to be equally spaced apart as they service hall calls and car calls and therefore bunching is avoided.

According to the present invention, the position of each car is predicted over a given period of time by estimating when it will arrive and leave each of its committed stops over that period for a given set of hall call/car call assignments. A bunching measure is calculated and a car to hall call assignment is made in response to the bunching measure.

Advantages of the present invention include reduced registration time, as compared with the prior art dispatching schemes. As a consequence of avoiding bunching, cars tend to be evenly distributed throughout the building, and therefore, better positioned for servicing hall calls and car calls.

BRIEF DESCRIPTION OF DRAWINGS

FIG. 7 is a chart of estimated arrival and departure times at committed stops for elevator cars.

FIG. 8 is a chart of estimated car positions at five second intervals.

FIG. 10*a* is a chart of the estimated time of arrival and departure at the committed stops of four elevators assuming that a down hall call on floor 11 is assigned to an elevator A of the four elevators, A–D.

FIG. 10*b* is an estimation of car positions at five second intervals assuming assignments of the down hall on floor 11 to car A.

FIG. 11*a* is a chart of the estimated time of arrival and departure at the committed stops of four elevators but assuming that the down hall call on floor 11 is assigned to car B.

FIG. 11*b* is an estimation of car positions at five second intervals assuming that the down hall call at floor 11 is assigned to car B.

FIG. 14*a* is a chart of the estimated time of arrival and departure of elevator cars at their committed stops assuming that a down hall call on floor 31 is assigned to a car A of the four cars, A–D.

FIG. 14*b* is an estimation of the car positions of the four cars A–D at five second intervals assuming that a down hall call on floor 31 is assigned to a car A of the four cars, A–D.

BEST MODE FOR CARRYING OUT THE INVENTION

Figure 1:
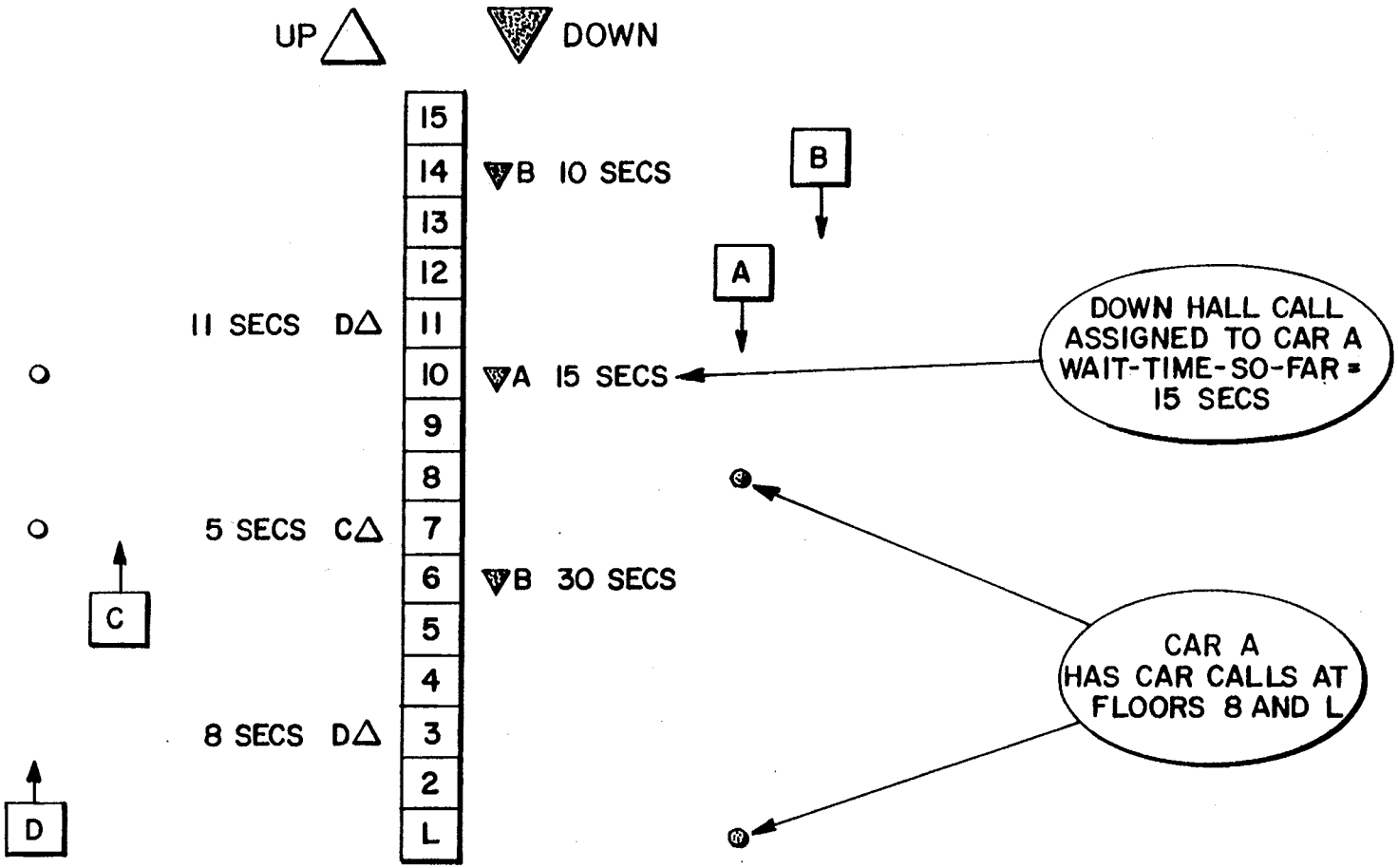
FIG. 1 is a snapshot at a specific moment in time of hall calls and car calls mapped to floors and cars.

Assigning a hall call to a car in response to a multi-term objective function employing a bunching measure as one term is described.

Dispatching cars to hall calls can be done with or without instantaneous car assignment (ICA). According to a dispatching scheme called instantaneous car assignment (ICA), once a car has been assigned to a hall call, the assignment may not be changed unless unforeseen events have occurred which cause the initial assignment to be of exceptionally inferior quality. Unlike traditional elevator assignment techniques, ICA informs the user at the instant of first assignment (or shortly thereafter) as to which car will service his/her hall call. The benefit is that the user can be walking toward that particular car, of the bank of cars, which is going to serve him and be positioned and ready to enter that car when it arrives.

Assigning a hall call to a car in response to an objective function employing a bunching measure consists of two parts. First, for a new hall call, a car is assigned to the call by choosing the car which provides the minimum value of the objective (meaning goal) function:

$$\text{OBJ}(\text{icar}) = A \cdot RRT + B \cdot PRT - 20 + \delta \cdot C \cdot (\text{maxPRT} - 60)^2 + D \cdot RSR + E(ABM).$$

Each term is discussed in detail below.

Objective functions used in elevator dispatching are not new, see U.S. Pat. No. 4,947,885 "Group Control Method and Apparatus for an Elevator System with Plural Cages". The RSR algorithm uses an objective function. The RSR algorithm and various modifications of it can be said to include various terms, depending on the RSR algorithm employed. The basic component of the RSR quantity is an estimate of the number of seconds an elevator would require to reach a hall call.

However, the use of the particular objective function, the selection of the terms of the objective function, the use of an objective function in combination with ICA and the assignment of cars to hall calls directly as a function of elevator system performance metrics are, among other things presented here, new.

The second part of the invention is the instantaneous car assignment (ICA) feature in combination with the objective function. For a hall call that has been waiting for some time with a car already assigned, switching the assignment to another car is unlikely according to the present invention. Under no circumstances will more than one reassignment be allowed. A switch, that is a reassignment, is permissible under two exceptional circumstances: 1) there is a car other than the assigned one that can reach the call significantly faster (for example, by at least 40 seconds) and 2) the assigned car is traveling away from the call (for example, the car assigned to an up hall call is traveling upwardly above the call). In the case where a switch is permissible, the assignment is made based on the objective function. The values of the coefficients A, B, C, D and E can be varied to reflect the preference of the building owner. It is also clear that by setting all but one coefficient to zero, dispatching assignments can be made based on a single metric.

RRT (remaining response time)

The term remaining response time is fully described in U.S. Pat. No. 5,146,053 entitled "Elevator Dispatching Based on Remaining Response Time", issued jointly to one of the same inventors as the present invention. It is an estimate of the number of seconds an elevator would require to reach the hall call under consideration given its current set of assigned car calls and hall calls. It is sometimes referred to in the elevator industry as estimated time of arrival (ETA).

Figure 2B:
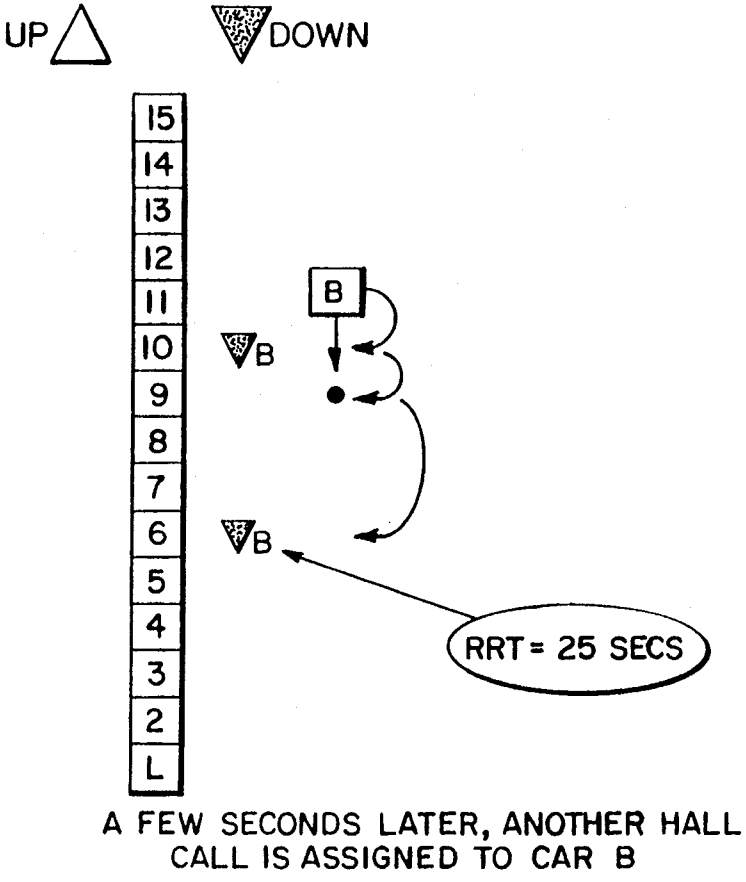
FIG. 2 maps floors against the location of a car B and car calls and hall calls for assignment for car B.
Figure 2A:
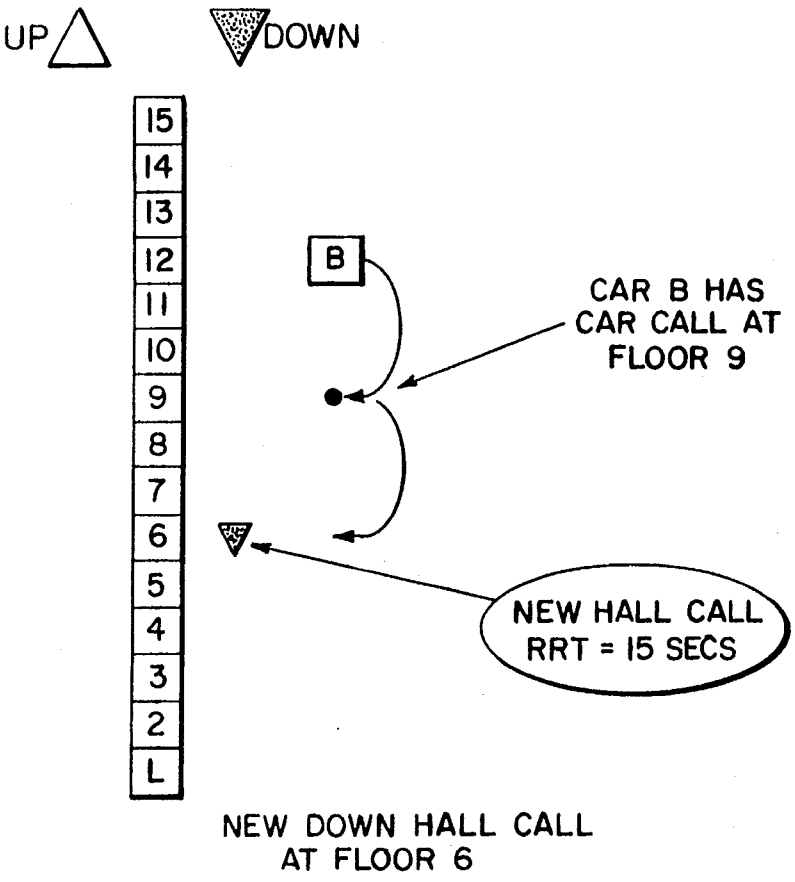

FIG. 2 illustrates a car B moving in the down direction and positioned at floor 12 on its way to service a car call at floor 9. At this point, a new hall call is registered at floor 6. The remaining response time for the new hall call for car B is an exemplary 15 seconds. A few seconds later, another hall call is assigned when the car B, still moving downwardly in the direction of its car call at floor 9 and assigned hall call at floor 6, when another hall call is assigned to it at floor 10. The additional hall call at floor 10 increases the remaining response time of the call at floor 6 to 25 seconds from 15 seconds.

Figure 3:
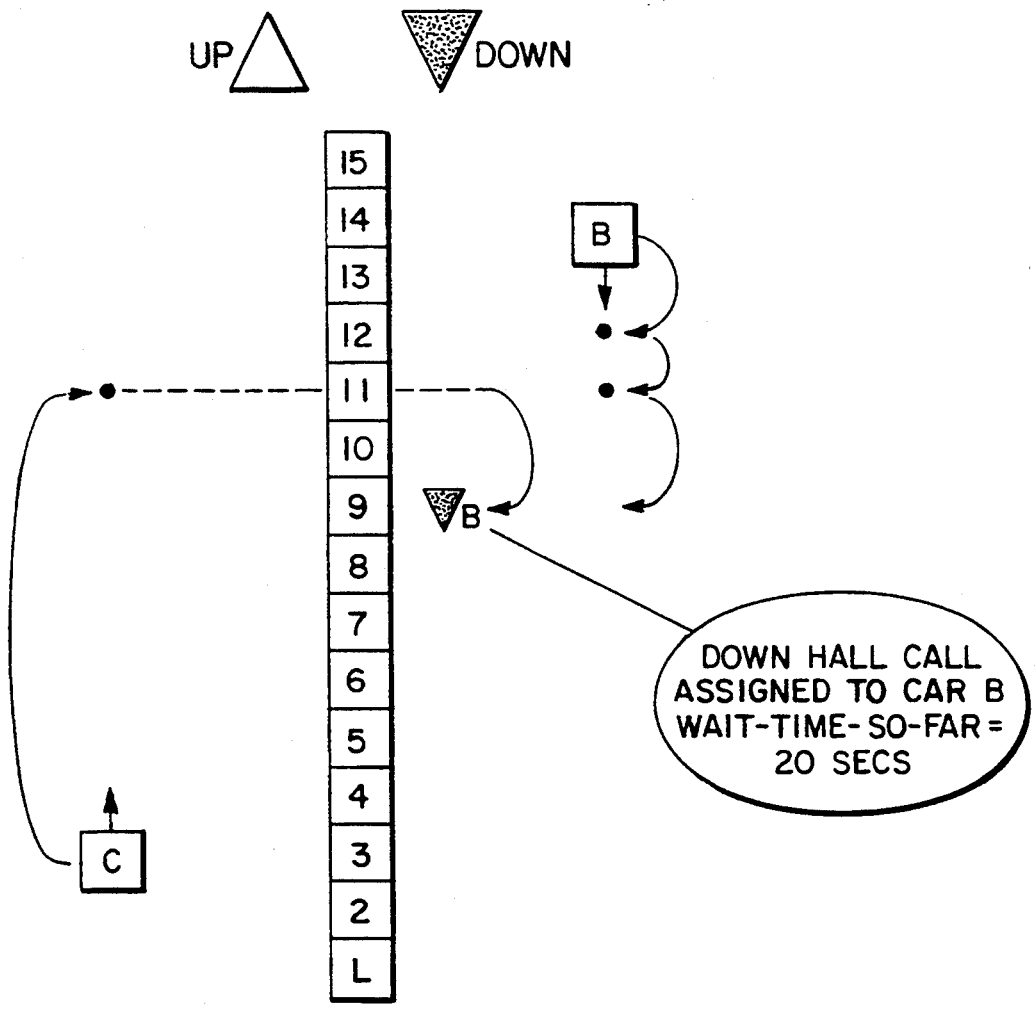
FIG. 3 is a mapping of floors against the location of cars B, C and car calls associated with those elevators and a hall call associated with car B.

FIG. 3 maps floors in a building against car calls for cars B and C and a hall call assigned to car B. FIG. 3 illustrates the remaining response time concept after a hall call has already been waiting an exemplary time of 20 seconds. In FIG. 3 a car B is traveling in the downward direction to service two car calls before servicing a hall call assigned to car B where the passenger has already been waiting for 20 seconds. Meanwhile, a car C is moving in the upward direction to service a car call at a floor above the location of the hall call. The question arises as to whether the hall call should remain assigned to car B or be reassigned to car C.

Where the assignment of cars to hall calls is based purely on remaining response time, the remaining response time for assignment to car B is compared to the remaining response time for car C to evaluate the merit of the current assignment and determine whether a switch, that is a reassignment, from car B to car C would be a good idea.

Also, if the trip to reach a hall call in the opposite direction includes an assigned hall call in the direction of travel, then for the purposes of remaining response time computation the car is assumed to go to the terminal floor. (For example, consider a car traveling up at floor five with a car call at 7 and an assigned hall call at floor 9. Now, a down call is registered at floor 10. To estimate the remaining response time of the car, the car is assumed to be sent to the top terminal to fulfill the car call resulting from the hall call at floor 9 before it can reach floor 10 in the down direction). Upon reflection, it can be seen that this assumption that the cars go to the terminal floor is not necessarily the worst case.

We assume that only one car call results from the up hall call at floor 9, and that is to the terminal floor (the top). A much worse situation would be if several people were waiting behind the hall call at floor 9, and each pressed a different car call button. For this worse case, the RRT would obviously be much longer, due to additional stops.

PRT (predicted registration time)

Figure 4:
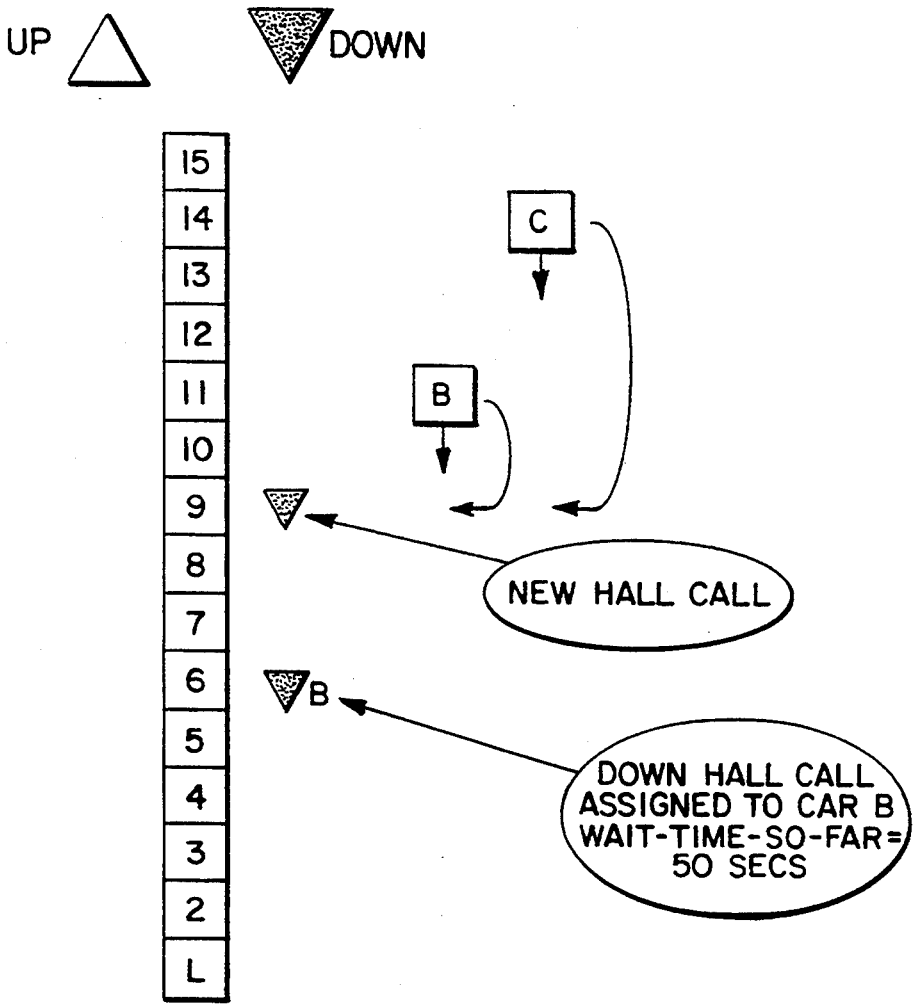
FIG. 4 is a map of floors against registered hall calls, and the location of cars B, C.

This metric is the sum of the amount of the time that the call has already been waiting (the wait-time-so-far) and the RRT. For a new hall call, PRT=RRT. FIG. 4 illustrates why assignment of hall calls based solely on remaining response time is not sufficient for good hall call assignments and why predicted registration time is important. Car B is presently at floor 11, car B is moving downwardly to service a hall call assigned to it at floor 6 where the passenger's wait-time-so-far is (a very long) 50 seconds when a new hall call is registered at floor 9. Another car C at floor 14 is also moving downwardly. The remaining response time of car B for the new hall call at floor 9 is six seconds. The remaining response time of the car C with respect to the new hall call at floor 9 is 15 seconds, because the car C is farther away from the new hall than car B. It would seem at this point that the logical selection for the assignment for the hall call is car B. Under certain circumstances, this assignment would not be appropriate, however, because of the effect of that assignment on other calls. The predicted registration time for the call at floor six if car B is assigned to the hall call at floor 9 is increased to 65 seconds. The predicted registration time for the call at floor 6 if car B is assigned to the hall call at floor 9 is 55 seconds. Thus, assigning the car B to the new hall call at floor 9 based on the shortest remaining response time comparison for the two cars results in a very long predicted registration time for the passenger at floor 6. The predicted registration time results where an assignment is made purely as a function of the remaining response time metric is poignant where an extra 10 seconds of waiting for the passenger at floor 6 is the difference between an anxious passenger and a furious passenger, as a consequence of the nonlinearity of passenger frustration as a function of waiting time.

Hence, the wisdom of including the predicted registration time in the objective function.

The predicted registration time metric is included in the objective function as the absolute value of the difference between the predicted registration time and the term, $T_1$, of 20 seconds. If the predicted registration time is either very short or very long, then the term, $T_1$, penalizes a car. This reflects the philosophy in some markets that a passenger is willing to wait approximately 20 seconds without any level of discomfort. Of course, this penalty term is variable and need not be 20 seconds. Therefore, a car that could reach the hall call in a very short time (for example, five seconds) might better proceed to answer other more urgent elevator system demands.

maxPRT (maximum predicted registration time)

Waiting times in excess of 90 seconds are considered very long while their frequency is low (once or twice in a two hour heavy two-way traffic). Their effect is a major irritant to passengers. It is important to reduce both the magnitude and frequency of these long-waiting calls. The present invention proposes to address these long calls by penalizing the car for an assignment only when that assignment will cause the longest waiting call (of all hall calls presently waiting) to wait longer than a term, $T_2$, 60 seconds. It is thought that a call that has already waited 60 seconds has a potential to cross the 90 seconds threshold and therefore should be given special consideration. The penalty term is variable and need not be 60 seconds. The term is squared in the objective function to reflect the passengers growing irritation which is felt to be nonlinear and increasing as the waiting time increases beyond 60 seconds. Obviously, the term maxPRT, like PRT, need not be squared but could be the argument for any other function to model passenger irritation. The Dirac Delta operator ensures that the third term is zero where maxPRT is not longer than 60 seconds.

RSR (relative system response)

This metric is used currently in the objective function in order to allow the building owner to revert to the prior art RSR dispatching methodology.

The value of the RSR term selected depends upon which form of RSR is desired, as it has many modifications. The basic component of the RSR quantity is the estimated amount of time for a car to reach the hall call whose assignment is being determined. The value selected, however, for the RSR value may be any of those shown in U.S. Pat. No. 5,146,053 issued to Powell et al entitled Elevator Dispatching Based on Remaining Response Time; U.S. Pat. No. 4,363,381 issued to Bittar, entitled Relative System Response Elevator Call Assignments; U.S. Pat. No. 4,815,568 to Bittar entitled Weighted Relative System Elevator Car Assignment System with Variable Bonuses and Penalties; U.S. Pat. No. 4,782,921 to MacDonald et al. entitled Coincident Call Optimization in an Elevator Dispatching System; U.S. Pat. No. 5,202,540 issued to Auer entitled Two-way Ring Communication System for Elevator Group Control; U.S. Pat. No. 5,168,136 issued to Thangavelu et al entitled Learning Methodology for Improving Traffic Prediction Accuracy of Elevator System Using Artificial Intelligence; U.S. Pat. No. 5,035,302 issued to Thangavelu entitled Artificial Intelligence based Learning System Predicting Peak-Period Times for Elevator Dispatching; U.S. Pat. No. 5,024,295 issued to Thangavelu entitled Relative System Response Elevator Dispatcher System Using Artificial Intelligence to Vary Bonuses and Penalties; U.S. Pat. No. 5,022,497 issued to Thangavelu entitled Artificial Intelligence Based Crowd Sensing System for Elevator Car Assignment; and U.S. Pat. No. 4,838,384 issued to Thangavelu entitled Queue Based Elevator Dispatching System Using Peak Period Traffic Prediction, incorporated by reference. The bonuses and penalties making up the RSR term can be varied or fixed.

BUNCHING MEASURE(BM)

For understanding the invention, a building's floors are represented on a circle (FIG. 5), and the cars travel in a clockwise direction. The cars are perfectly distributed if they are in positions as shown. Up and down are indicated by "U" and "D" after the floor number. The arc distance between each car is the same—seven floors. Cars are proximate if a) there is no car between them commanded to travel in the same direction or parked between them and b) there is no car between either of them and a terminal. For example, A and B are proximate cars but A and C are not.

A defined bunching measure is the sum of the squared distances between cars:

$$\begin{aligned}\text{Bunching Measure} &= 7^2 + 7^2 + 7^2 + 7^2 \\ &= 196\end{aligned}$$

Figure 5:
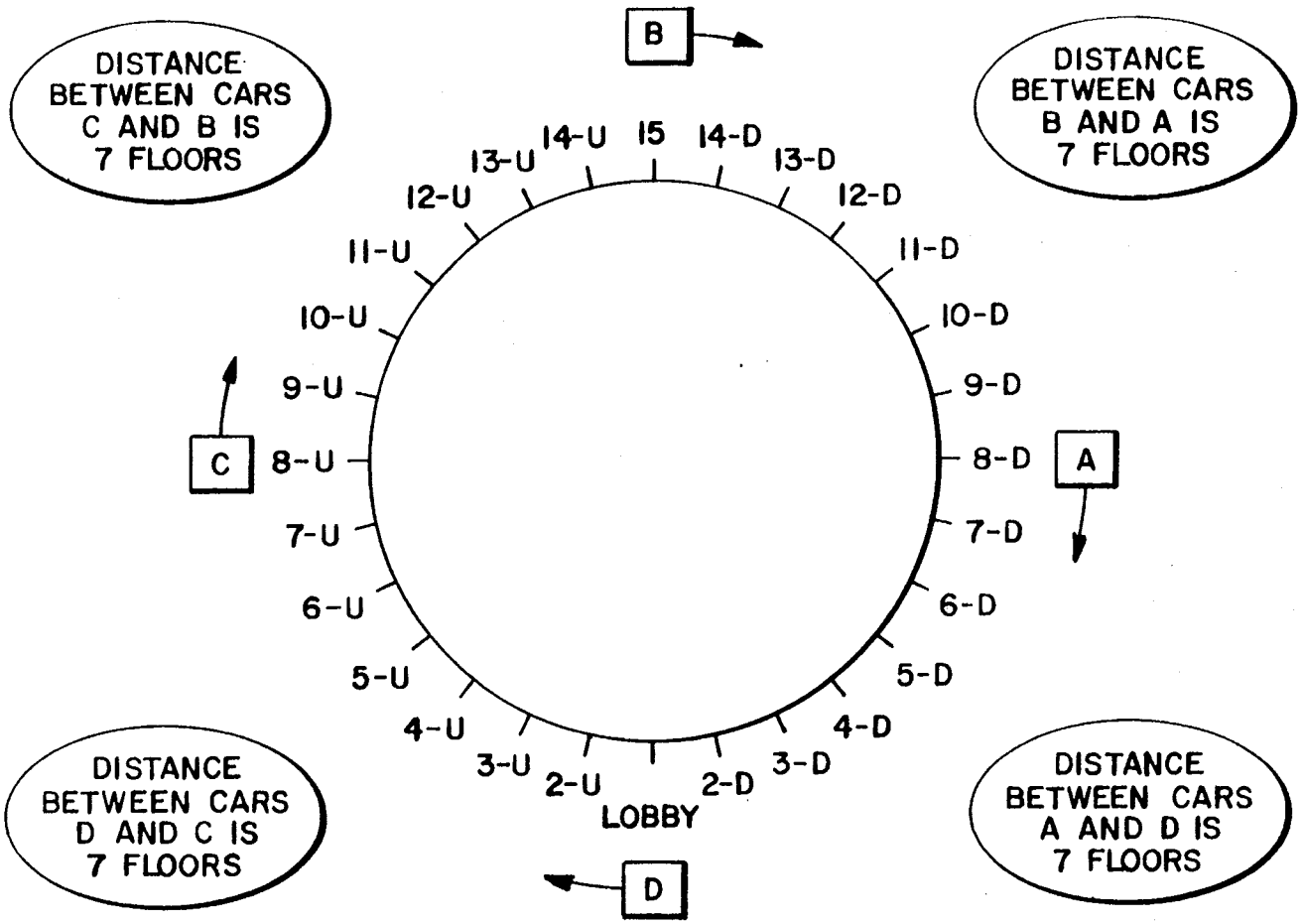
FIG. 5 is a circular model of the floors in a building, and the up or down directions, for an equal distribution of elevator cars.

FIG. 5 represents the ideal distribution of cars. In fact, it can be shown mathematically that this sum of squares is minimized when all of the distances are seven. This mathematical result generalizes for N cars serving F floors. The sum of squares is minimized when the distances are all equal to 2(F-1)/N.

Figure 6:
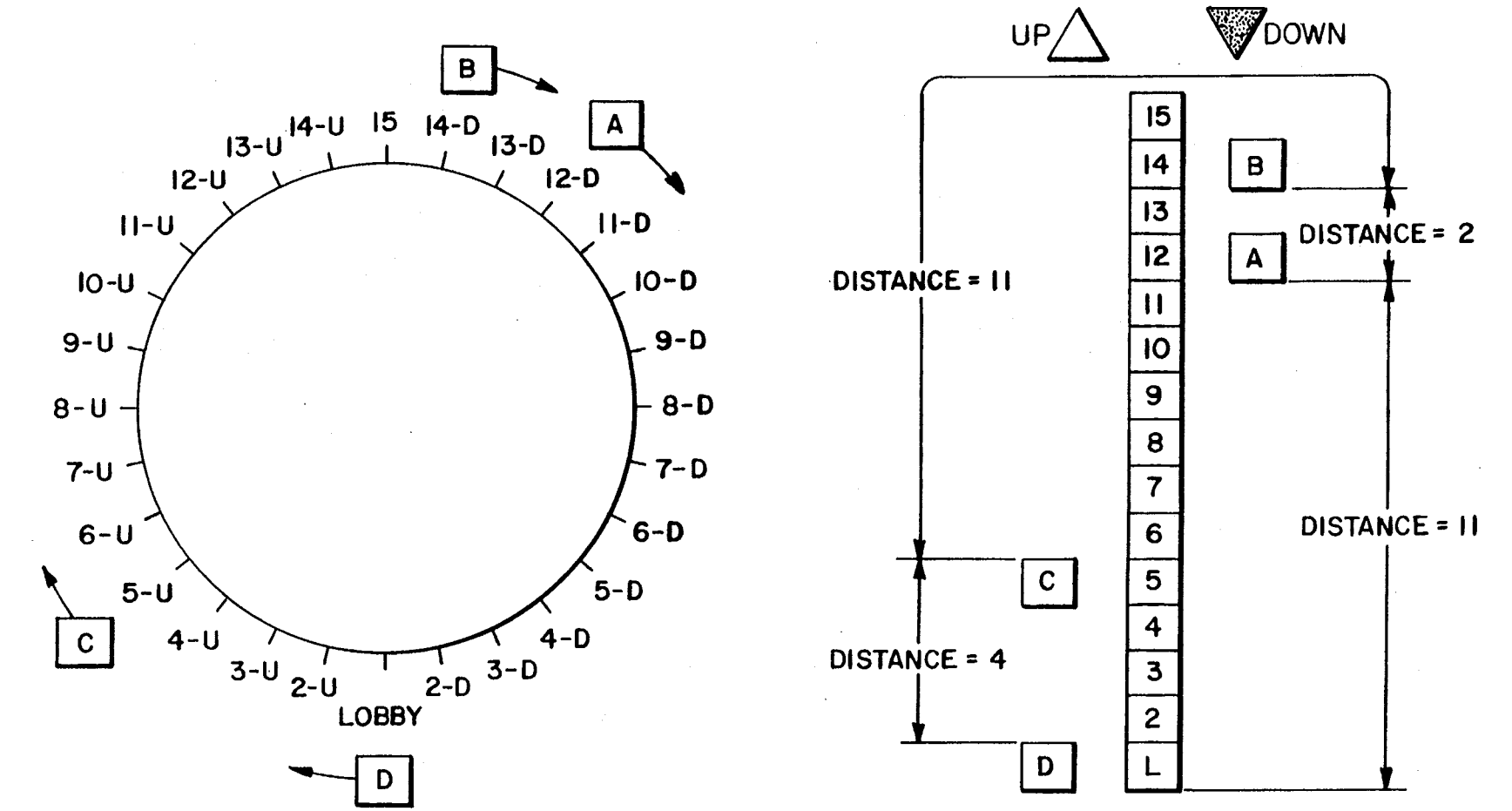
FIG. 6 is a circular model as in FIG. 5, but for an unequal distribution of cars and an associated snapshot without hall calls or car calls shown.

Now if this distribution represents the ideal, then the severity of bunching can be determined by the extent that the measure deviates from this ideal. FIG. 6 shows the cars in positions that they were in FIG. 1. The measure of bunching is $$\text{Bunching Measure} = 4^2 + 11^2 + 2^2 + 11^2 = 262$$

When two cars get close to each other, the distance to the next (or previous) car increases. By squaring the distances, we place greater emphasis on the large distances. Therefore, when bunching becomes more severe, the bunching measure is larger.

Prediction of Bunching Over Next 30 Seconds

The method of squaring distances provides a quantitative measure of bunching for a group of elevators at a single instant in time. Although this is useful, a more important issue is the likelihood for the cars to become bunched in the next 30 seconds. Say that a new hall call has been registered, and the dispatcher must assign a car to it. The following question is crucial:

How will the assignment that the dispatcher makes now affect bunching in the near term future (say, the next 30 seconds)?

This question can be addressed by predicting bunching over the next 30 seconds.

For the situation of FIG. 6, it is possible to predict the position of each car A–D in the next 30 seconds by estimating when the cars will arrive at and leave from each of its their committed stops. FIG. 7 shows the results of such a process. Assume first that no new hall calls or car calls are entered. Then, Car A will arrive at floor 10-DOWN at time 4.0 seconds from now and will leave Floor 10-DOWN at time 10.0, will arrive at Floor 8-DOWN at time 14.0, etc. The HC indicates when a hall call is canceled. The arrow indicates the direction a car is heading in.

The second phase of the process is to take the position data of FIG. 7 and interpolate to obtain car positions at regular intervals. FIG. 8 shows the estimated car positions at five second intervals. Then, for each five second epoch, a measure of bunching can be calculated by squaring the distances. Finally, an average bunching measure (ABM) over the next 30 seconds is obtained.

The method of estimating future car positions can be done any number of ways. Although the success of the present invention will depend on the accuracy of the estimates, the method of estimation is NOT part of the present invention. For the examples cited, a simplification was made where a car would require two seconds per floor to travel and would remain at each stopped floor for six seconds. In practice, known floor-to-floor travel times would be used, and a better estimate of stopped time would be obtained from load-weight and other relevant information.

Figure 9:
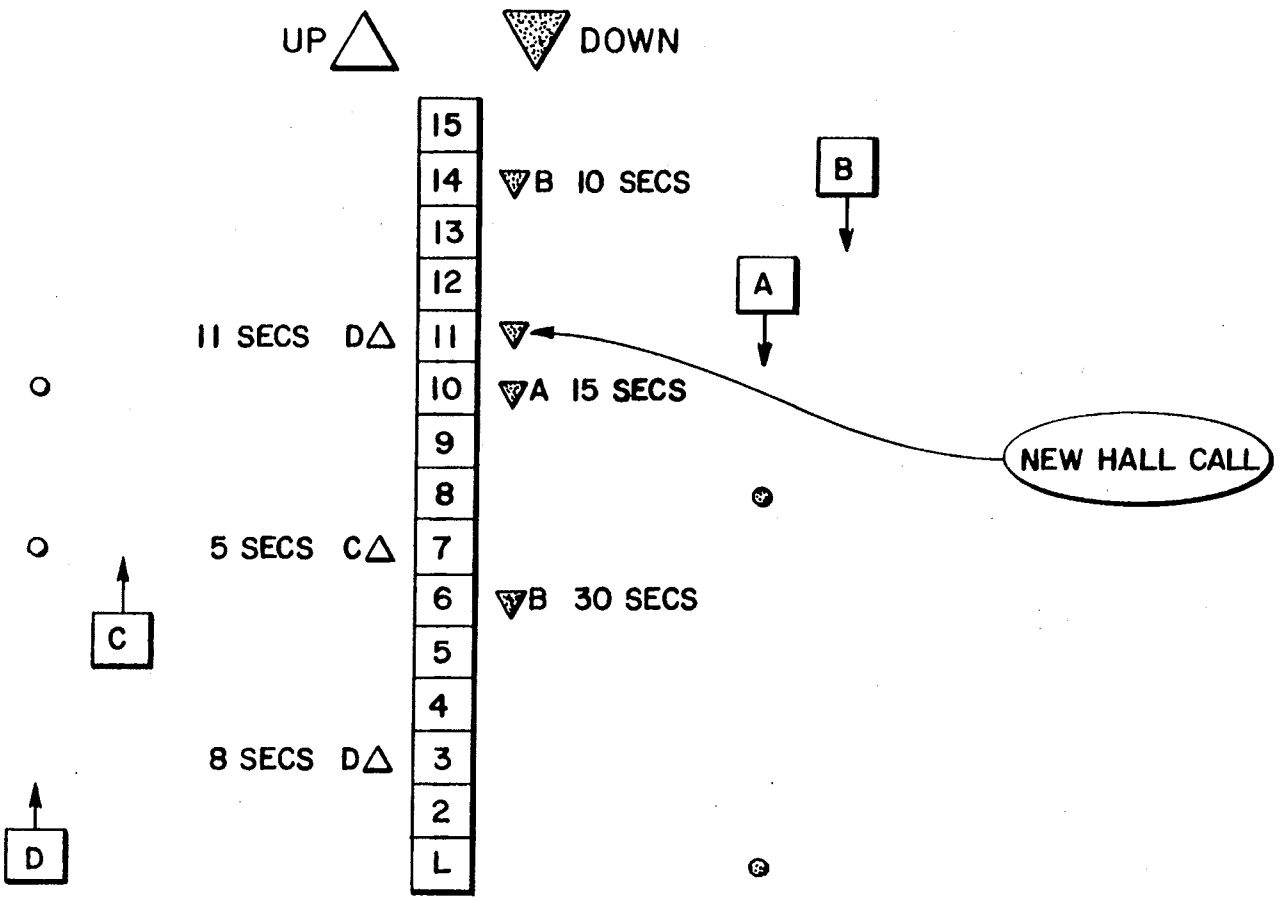
FIG. 9 is a snapshot at a specific moment in time of hall calls and car calls mapped to floors and cars.

FIG. 9 shows a new hall call registered at floor 11 but not yet assigned. As in FIG. 1 the wait-time-so-far for each hall call is shown also. FIGS. 10A and 10B correspond to FIGS. 4 and 5 except in FIGS. 10A and 10B the hall call at floor 11 is assumed to be assigned to car A for the purposes of determining what bunching will result. FIGS. 11A and 11B are similar to FIGS. 10A and 10B except the hall call at floor 11 is assumed to be assigned to car B. Because the average bunching measure is lower for the assignment of the hall call to car B, considering no other factors, the assignment should be made to car B rather than car A. FIGS. 10A, 10B, 11A, 11B are offered to show that the average bunching measure depends upon which car the hall call is assigned to, car B, for example, rather than car A.

Figure 12:
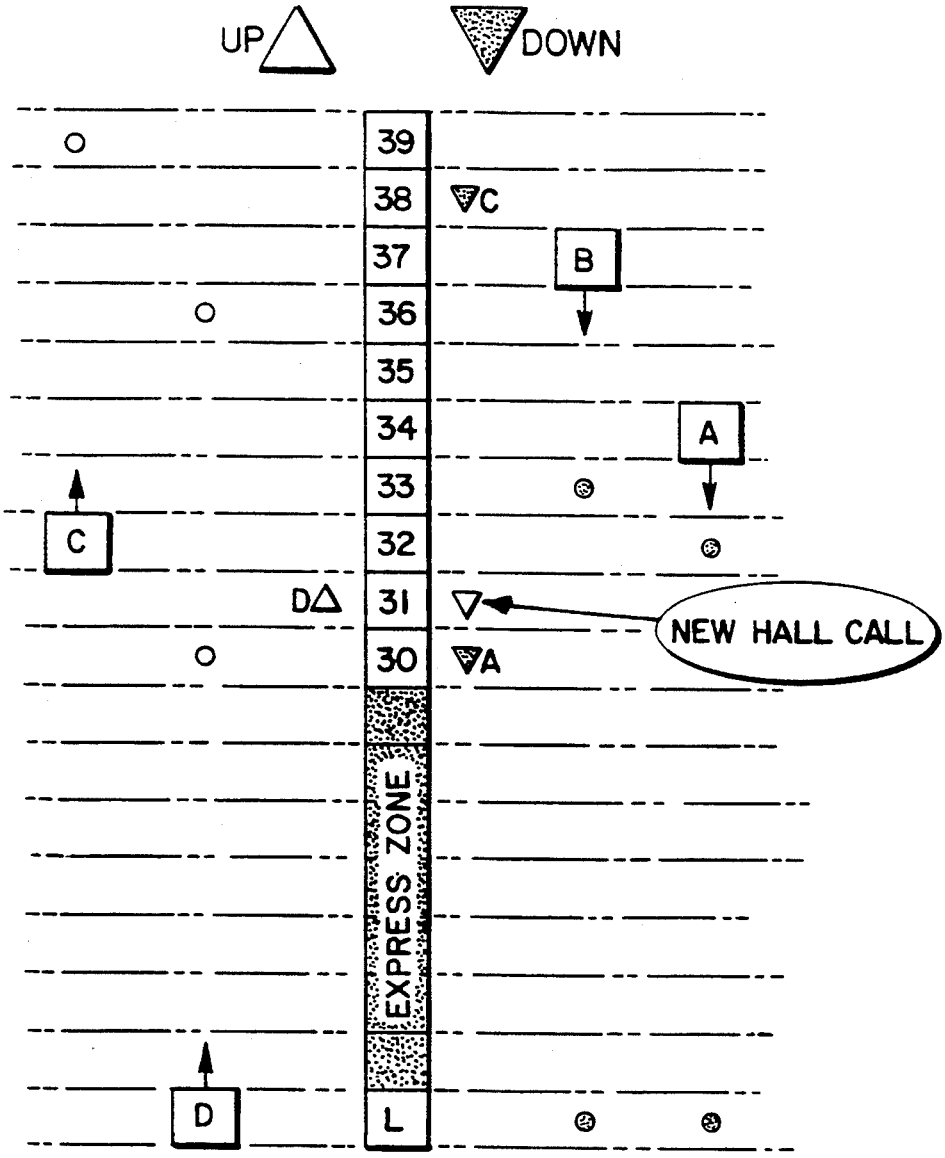
FIG. 12 is a snapshot at a specific moment in time of hall calls and car calls mapped to floors and cars in a building having an express zone.
Figure 13:
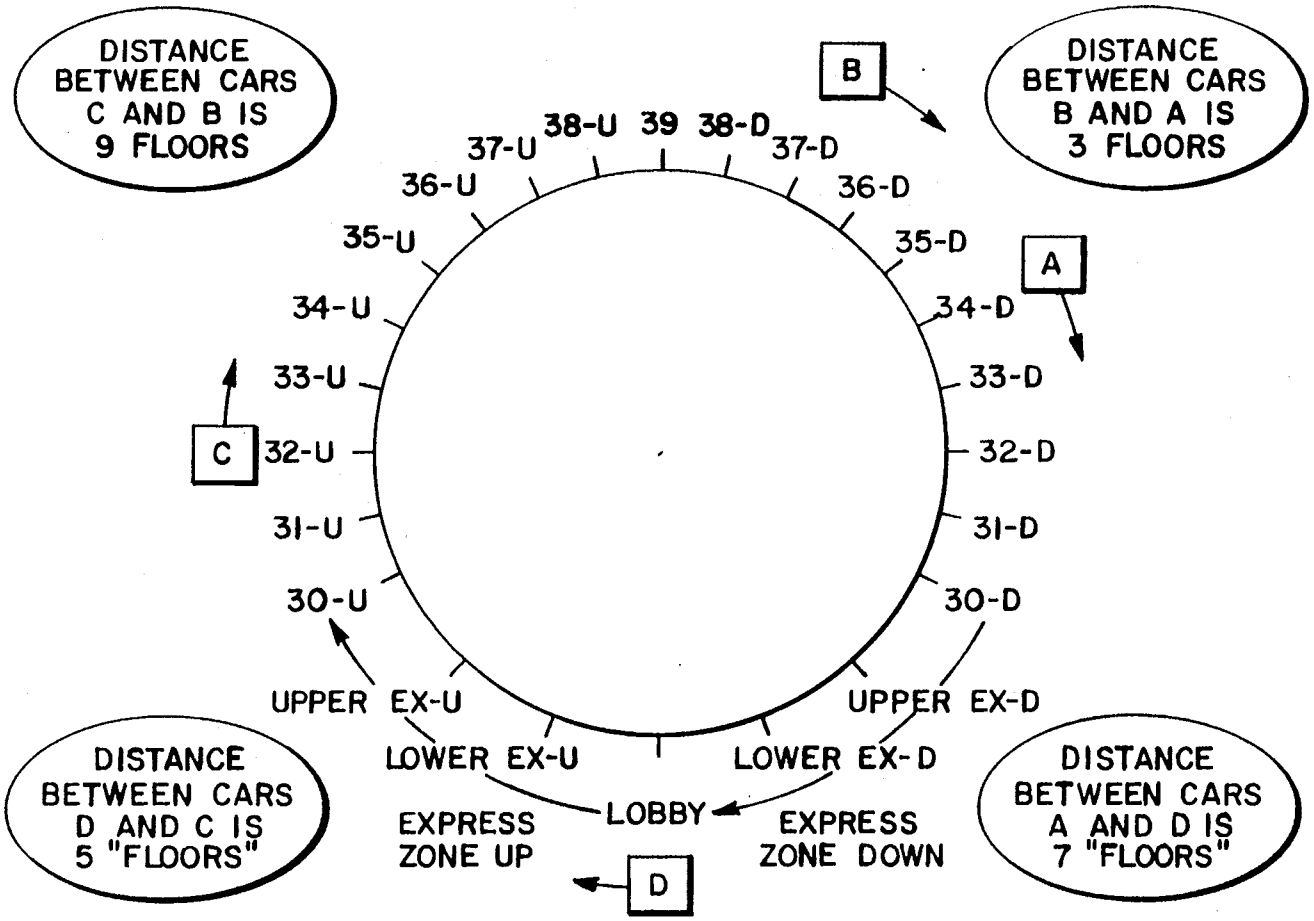
FIG. 13 is a circular model of the floors in the building, and the up or down directions, for a building having an express zone and an unequal distribution of cars.

FIGS. 12 and 13 show a bank of elevators in a building having an express zone wherein cars travel nonstop between the lobby and the 30th floor. The model in FIG. 13 divides the express zone in three segments. A car traveling upwards from the lobby is said to have completed each of the first two segments of its travel as it passes the two artificial "floors" Lower Express UP (Lower EX-U) and Upper Express UP (Upper EX-U). For the purposes of calculating bunching measures, a car traveling in the express zone is assumed to have a position at the nearest artificial floor. The determination of the number of segments to use in modeling the express zone is not exactly specified in this invention. The general intent is to treat local floors (those floors above an express zone) differently from floors in the express zone. At local floors, hall calls and car calls can cause a car to stop whereas the cars cannot stop while traveling within the express zone. For the example of FIGS. 12 and 13, the express zone travel is approximately 24 seconds. It has been assumed earlier in this application that the time required for a car to depart a particular floor, travel to an adjacent floor, and spend time at the adjacent floor is 8 seconds (2 seconds for travel and 6 seconds for stopping). For this case, the express zone travel is approximately equivalent to three local floors. Hence, three segments in the express zone.

For the situation of FIG. 12, it is possible to predict the position of each car in the next 30 seconds by estimating when a car will arrive at and leave from each of its committed stops. FIG. 14*a* shows the results of such a process. Assume first that no new hall calls or car calls are entered. Then, Car A will arrive at floor 32-DOWN at time 4.0 seconds from now and will leave Floor 32-DOWN at time 10.0 seconds, will arrive at Floor 31-DOWN at time 12.0 seconds, etc. The HC indicates when a hall call is canceled. Arrows indicate direction. Stops at a floor without the HC designation indicate car call stops.

The second phase of the process of measuring bunching is to take the position data of FIG. 14*a* and interpolate to obtain car position at regular intervals. FIG. 14*b* shows the estimated car position at five second intervals. Then, for each five second interval, a measure of bunching can be calculated by squaring the distances. Finally, an average bunching measure over the next 30 seconds is obtained.

Figure 15:
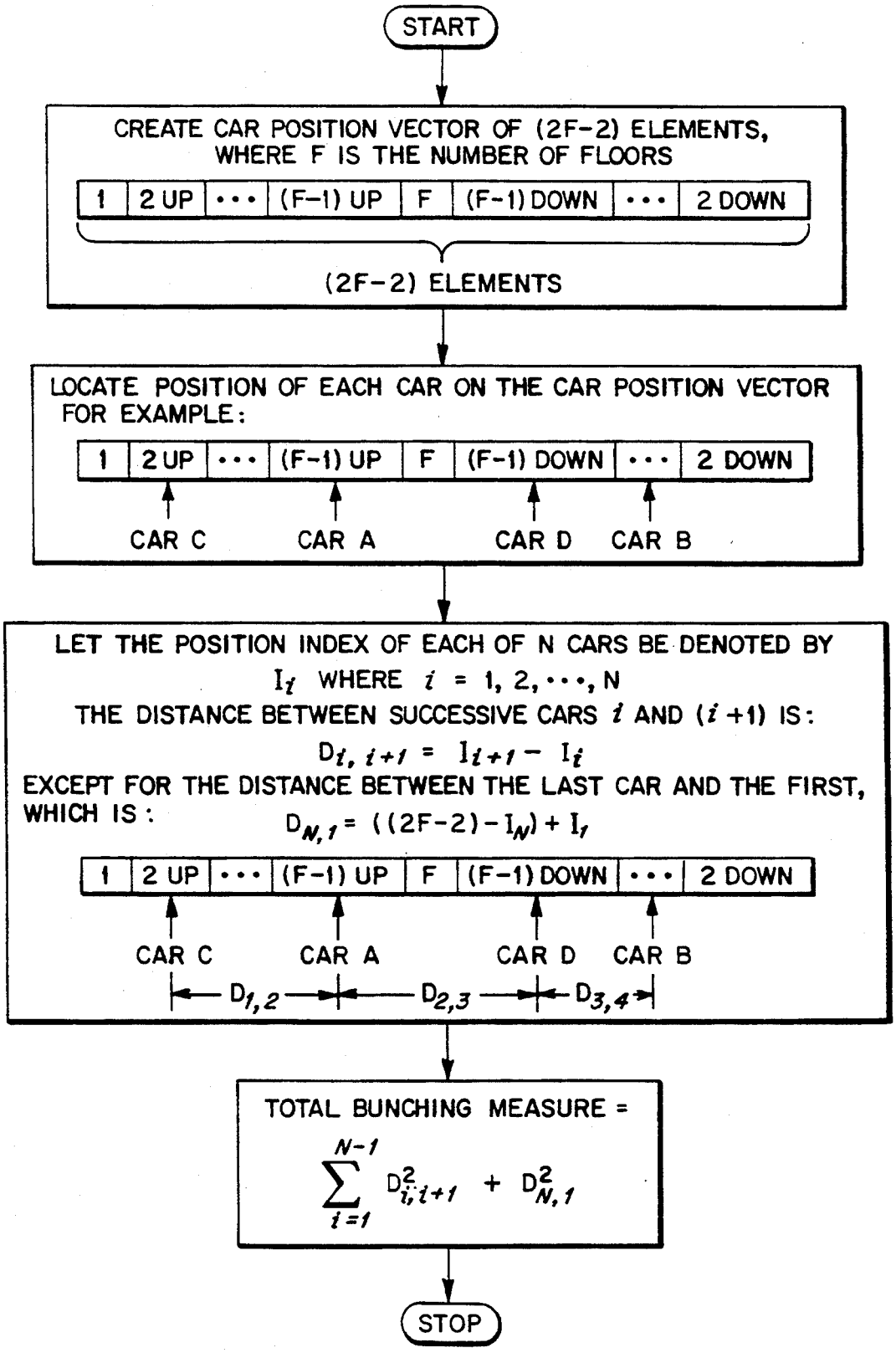
FIG. 15 is a flow chart for determining a bunching measure for elevator cars at given positions at a specific moment in time.
Figure 16:
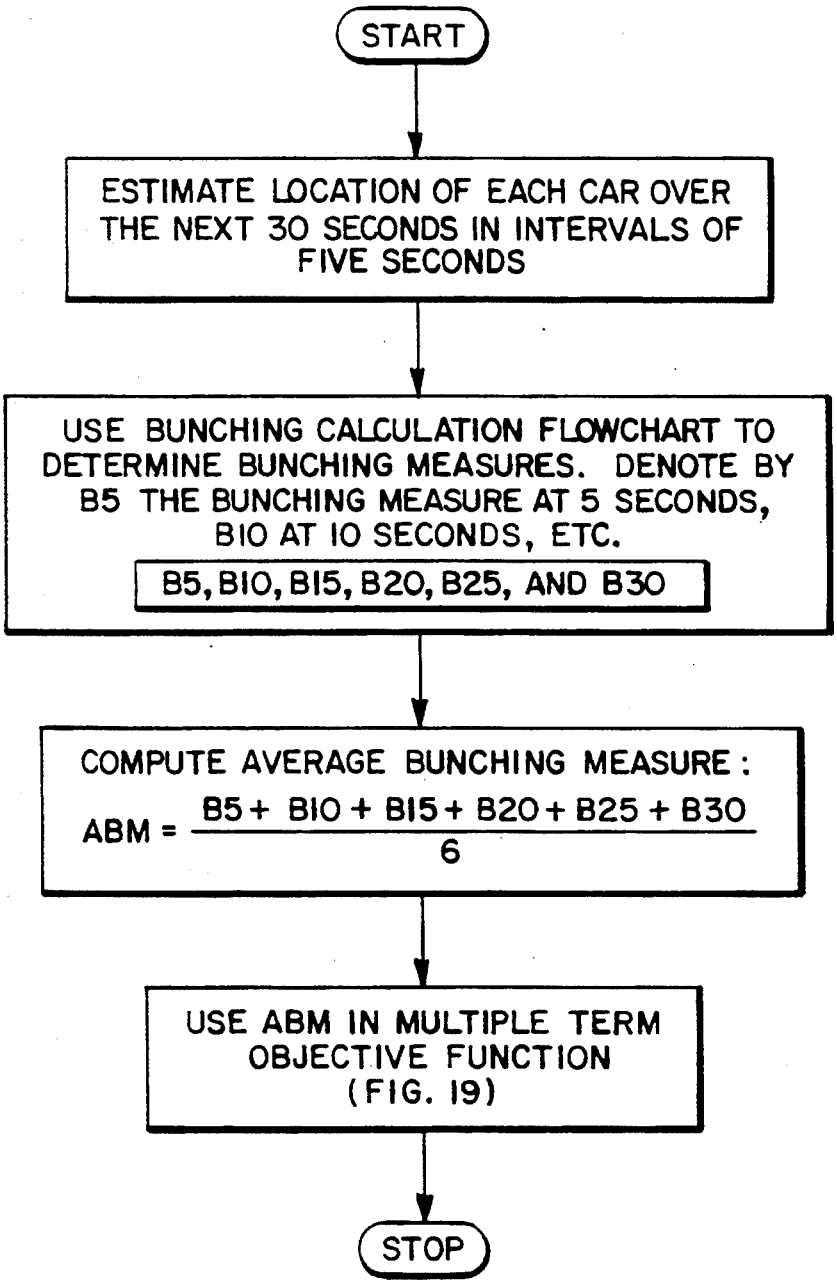
FIG. 16 is a flowchart for determining an average bunching measure over the next 30 seconds.

FIG. 15 is a flowchart for calculating a bunching measure at a given moment in time. FIG. 16 is a flowchart for calculating the average bunching measure predicted over the next 30 seconds.

The flowchart in FIG. 15 is executed each time a hall call assignment must be made. In FIG. 15, after a start, a car position vector is created within a computer in the elevator dispatcher. The car position vector is functionally the same as the circular model of FIGS. 5, 6, and 13; the linear model of FIG. 15 looks different from the circular one, but the former is merely the model of the latter on a straight line. The linear model is useful in calculating the bunching measure whereas the circular model is useful for understanding why a bunching measure that is a function of the distance between proximate cars and is effective in minimizing bunching. Adjacent cars on the linear or circular model are proximate cars. For example, A and B are proximate cars but A and C are not.

The car position vector includes (2F-2) elements where F is the number of floors from one terminal of an elevator run to the other. Each entry in the car position vector has a floor value and a direction value, either up or down, except for the floors at either terminal. The floor at the bottom terminal can only have an up direction value and the floor at the top terminal can only have a down direction value. As shown, these floors are 1 and F respectively.

Each element of the car position vector represents a possible position for a car in the building (for example, 2-UP is an element, 3-UP is an element, . . . , 2-DOWN). For the case where all floors are available to be serviced, and there is no express zone, each element in the car position vector corresponds to a stopping position (that is, a floor—direction pair). For a building with an express zone, one element is included for each 8 seconds of travel time for an elevator car travelling within the express zone less one. For example, with an express zone requiring 24 seconds to traverse for an elevator, there would be two elements in the up direction and two elements in the down direction. Floors which are not available to be serviced are treated like express zones except when there is an isolated floor interspersed among floors available for service, in which case these floors are not included as elements in the car position vector.

After the car position vector is created, the location of each car on the car position vector is determined. Algorithms for learning the position of an elevator car are well known as are algorithms for determining which direction an elevator car is moving (or will be moving if the car is stopped). Hence, this step includes merely collecting this data—floor position and direction of movement—for each car. Next, the distance between proximate cars is determined. A position index for each of the N elevator cars is denoted by $I_i$ which is equal to the cardinal index of the car-position element. For example, if car i had position at floor (F-1) in the down direction, then $I_i=(F+1)$ because the position $(F+1)$ is the $(F+1)^{st}$ element of the car position vector. N is the number of cars available to assign to a hall call. The value i can have a value, therefore, between 1 and N. The position index of each car is shown on the car position vector in FIG. 15. The distance between proximate cars i and (i+1) is $D_{i,i+1}=(I_{i+1}-I_i)$ except for the distance between the first and last car which is:

$D_{N,1}=[(2F\text{-}2)-I_N]+I_1$ where $I_1$ is the first car and $I_N$ is the last car.

As shown in FIG. 15, car C is the first car and car B is the last car. The position indices associated with these cars are $I_1$ and $I_4$, respectively, for the four car group shown.

Finally, the total bunching measure is calculated at a snapshot in time as:

$$\sum_{i=1}^{N-1} D_{i,i+1}^2 + D_{N,1}^2$$

FIG. 16 is a flowchart for providing the average bunching measure predicted over the next 30 seconds. After start, the location of each car at five second intervals over the next 30 second period is estimated. Next, the bunching measure at each five second interval is calculated for the next 30 seconds. This entails calling and executing the routine in FIG. 15 for each five second interval. Alternative to these first two steps of FIG. 16 is calculating the bunching measure for each five second interval in the same manner shown and described with respect to FIGS. 5–14*b*. That is, the time of arrival and departure at all committed stops in the next 30 seconds is estimated for each car, and then position data associated with these arrival times and departure times is interpolated to yield car positions at regular five second intervals. Next, the bunching measures for each of the five second intervals are summed and divided by the number of five second intervals in the 30 second period for providing an average bunching measure for that 30 second period. This is then used in the multi-term objective function described below.

Hall call assignment in response to the objective function will reduce bunching in proportion to the value of the coefficient, E, is chosen. That is, when E is large, the bunching term carries more emphasis. The actual value for E is tailored to meet a specific building's needs. The choice of E might be made to vary with building conditions. In fact, fuzzy logic rule of the type shown below could easily be implemented:

If Bunching Is SEVERE, then Use a HIGH value for E.

If Bunching is LOW BUT INCREASING, then use a MODERATE value for E.

The terms SEVERE, HIGH, LOW BUT INCREASING, and MODERATE would derive their meanings with reference to fuzzy sets.

Figure 17A:
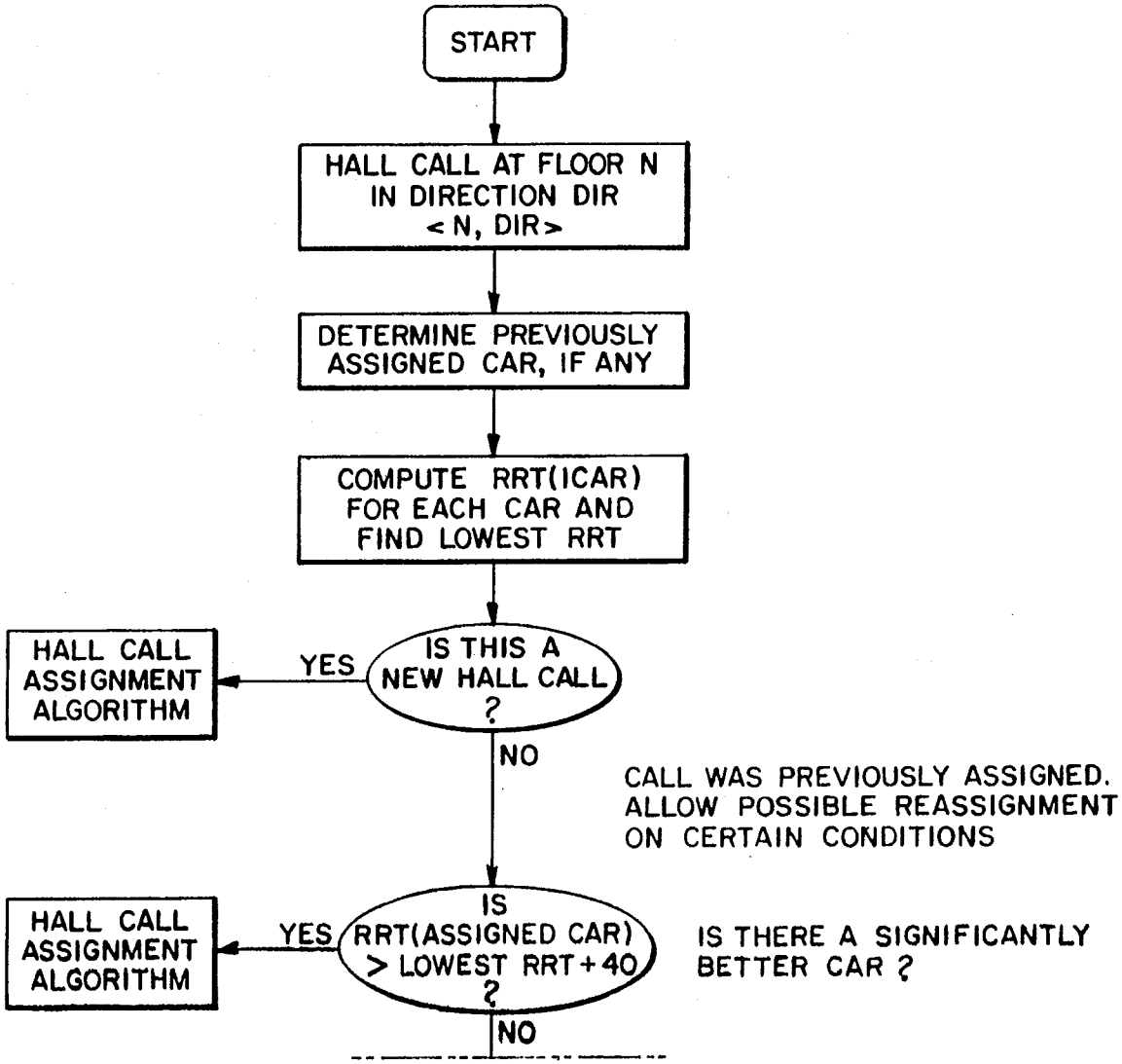
FIG. 17 is a master flowchart for illustrating the method of the present invention.
Figure 17B:
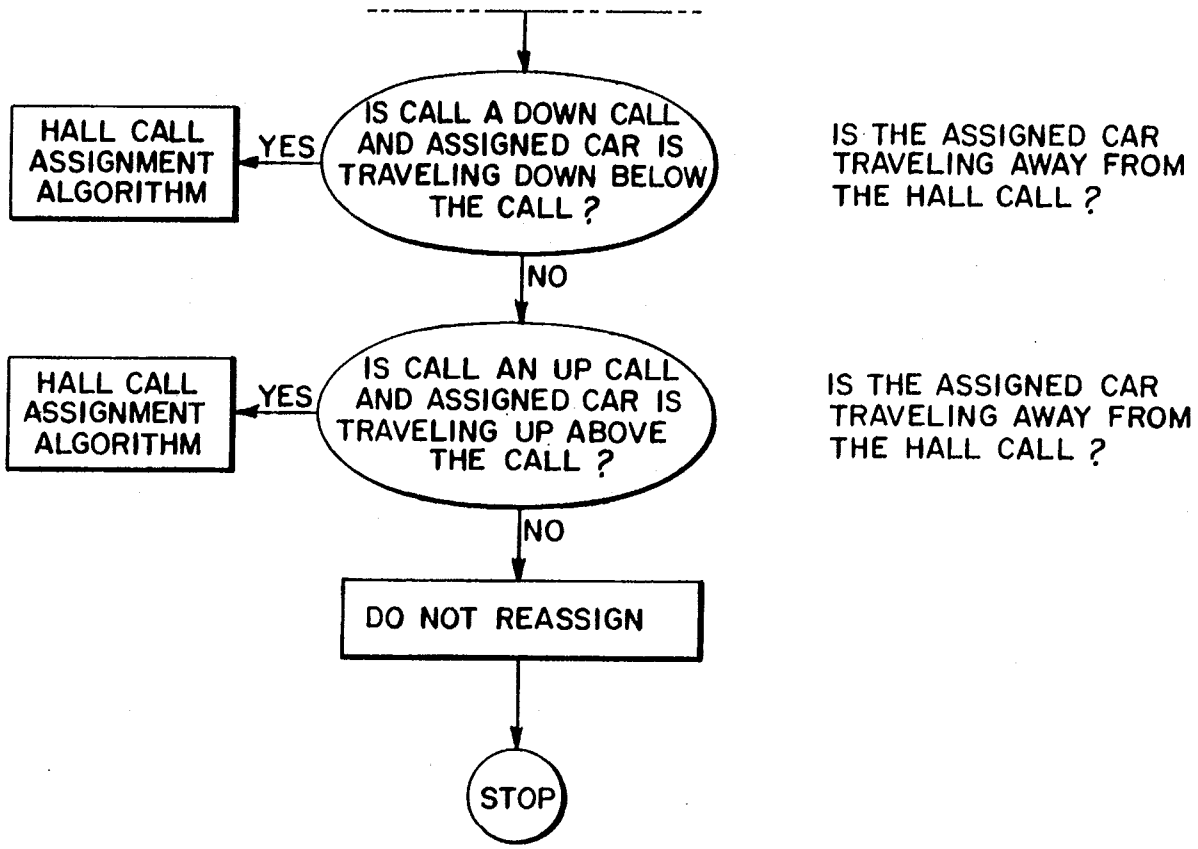

FIG. 17 is a master flow chart for implementing the method of the present invention. After a start, a hall call at a floor N in a given direction is registered. Then, an elevator dispatcher determines if the hall call was previously assigned to a car and records the car of the assignment. Next, the remaining response time is calculated for each car in the bank and the lowest remaining response time and the car associated with it is determined.

Figure 18A:
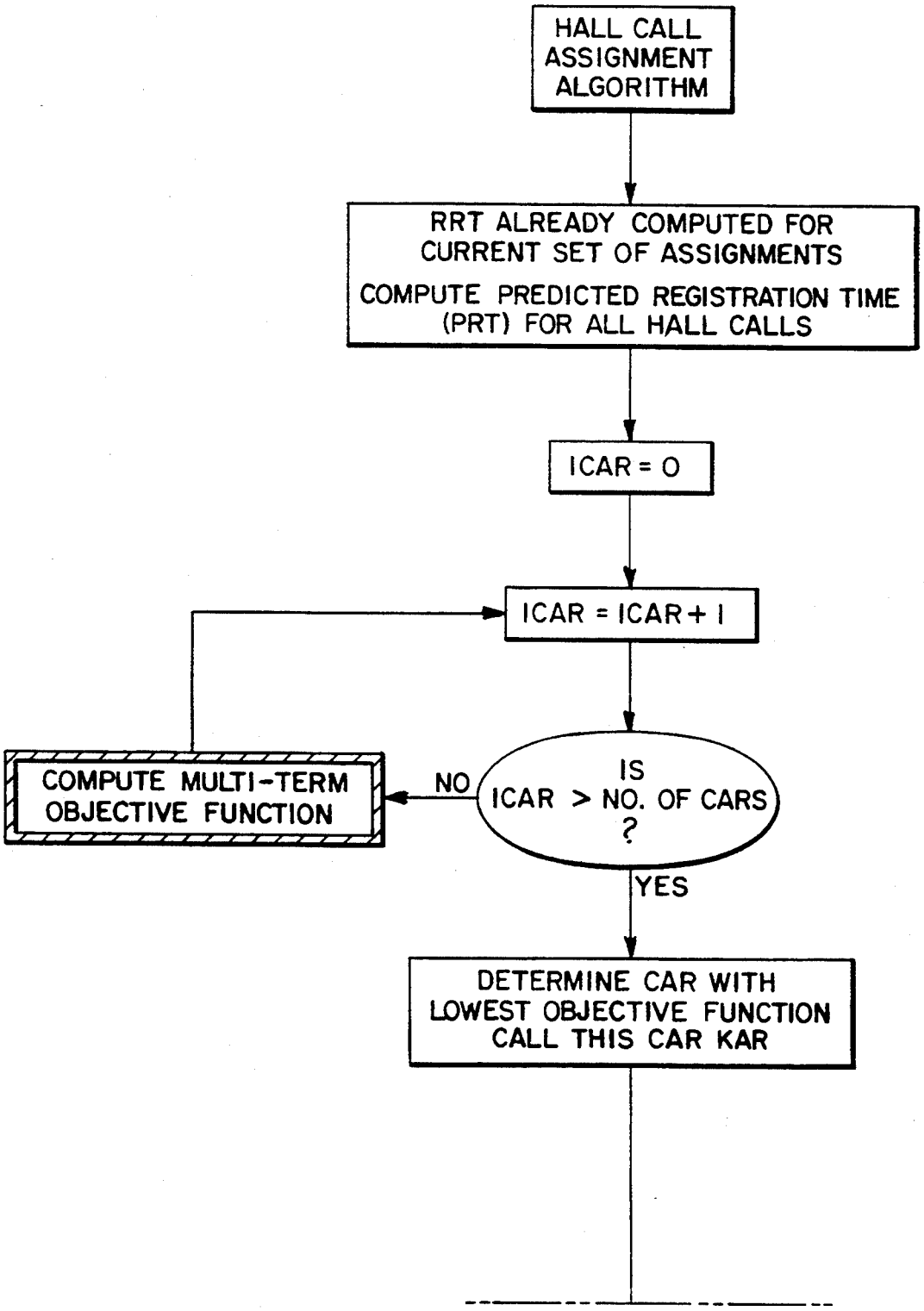
FIG. 18 is a flow chart of a hall call assignment algorithm.
Figure 18B:
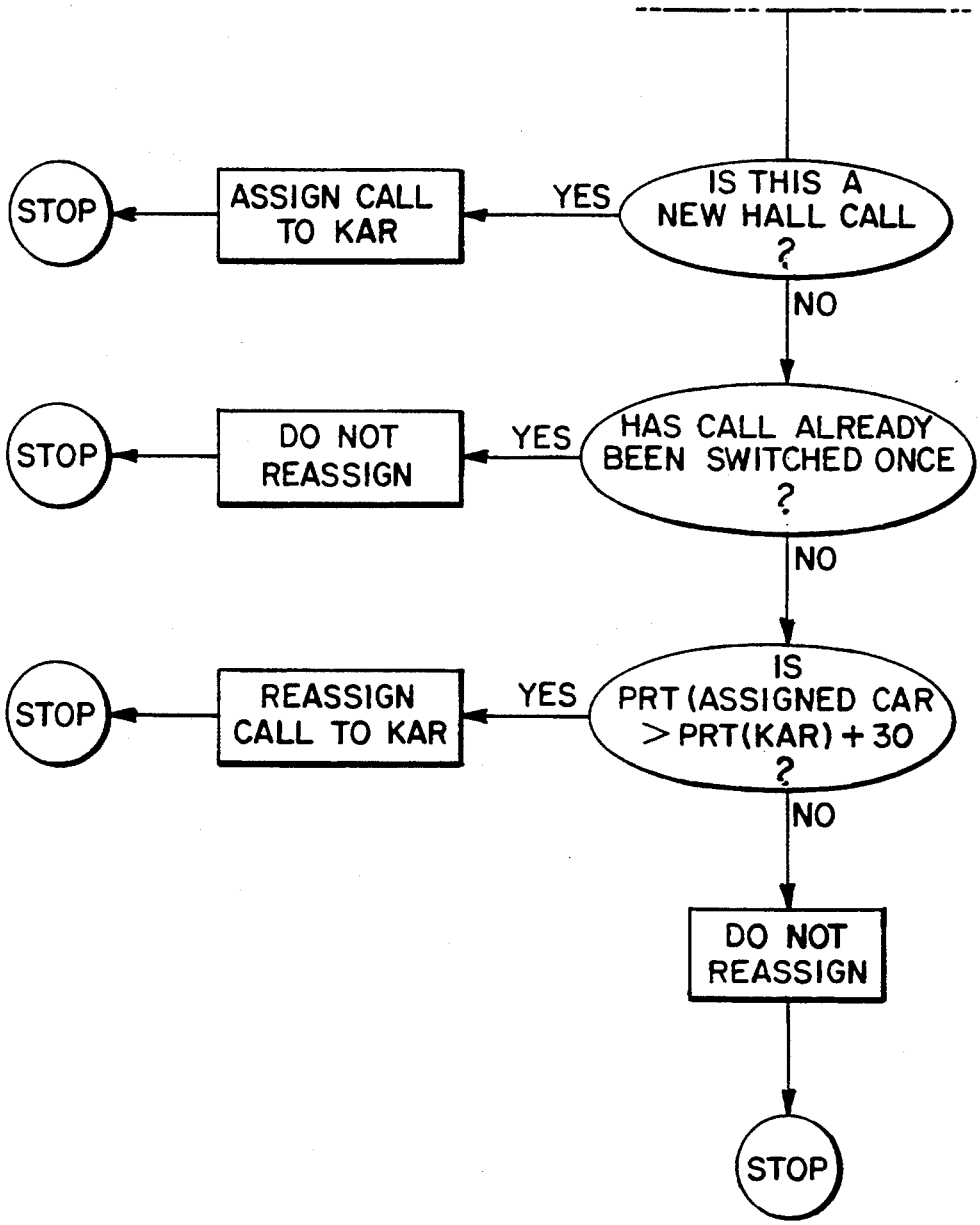

A series of tests is now executed to determine if a hall call assignment algorithm FIG. 18 for reassigning the call should be executed. The routines of FIG. 18 incorporate the basic concept of instantaneous car assignment in that the call is not reassigned unless there are strong incentives for doing so; even then, no more than one reassignment is allowed. The first test asks "Is this a new hall call?". If so, completion of the routine of FIG. 17 waits for execution of the hall call assignment algorithm illustrated in FIG. 18. If not, the next three tests may be executed for determining whether the previously assigned call should be reassigned. In test two, if the remaining response time of the assigned elevator is greater than the lowest remaining response time plus 40 seconds, execution of the routine at FIG. 17 waits until execution of the hall call assignment algorithm FIG. 18 for possible reassignment of the hall call to another car. This test indicates that reassignment is strongly discouraged but if the remaining response time of the present car is extremely poor with respect to the lowest remaining response time then reassignment should be considered. Extremely poor is defined by a variable predicted registration time difference, here 40. The third and fourth tests stall execution of the routine of FIG. 17 until the hall call assignment algorithm is executed if the assigned car is traveling away from the assigned call. None of these tests being met in the affirmative, there is no reassignment.

FIG. 18 illustrates the hall call assignment algorithm. First, the remaining response time already computed for the current set of assignments of hall calls to cars is read and used for computing the predicted registration time (PRT) for all hall calls, by adding the wait-time-so-far for each call to the associated remaining response time.

Next, a car index icar is set to zero. The index is incremented by one for each car in the bank, and a multi-term objective function is computed for that car, until all cars have been considered. Next, the car with the lowest objective function is determined and given a label KAR.

A series of tests is then executed for determining whether there should be a reassignment. These three tests are similar to the four tests of FIG. 17 insofar as their execution infrequently results in reassignment of a call out of deference to instantaneous car assignment. In the first test, if the hall call is a new one, then the hall call is assigned. If the hall call is not a new call (test two) and the call has already been switched once from the car of first assignment, then the hall call is not reassigned. If the call is not a new one, then the predicted registration time (PRT) of the assigned car is compared with the predicted registration time (PRT) of the car, "KAR", with the lowest objective function. If the predicted registration time (PRT) of the assigned car is far greater than the predicted registration time of the elevator with the lowest objective function, then the hall call is reassigned to the elevator car (KAR) with the lowest objective function, but otherwise, no reassignment occurs.

Figure 19:
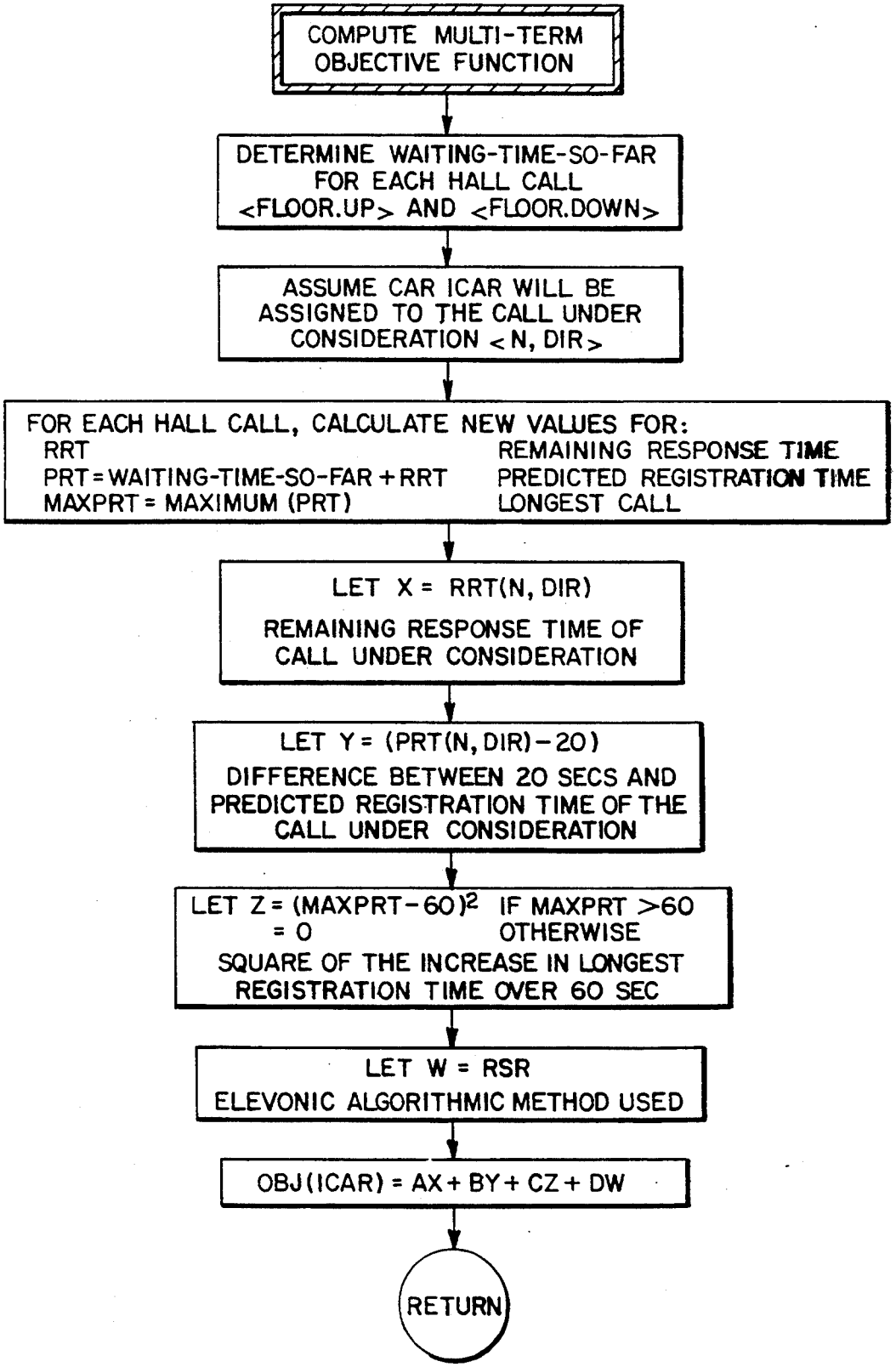
FIG. 19 is a flowchart for determining an objective function.

FIG. 19 illustrates calculation of the multi-term objective function. First, the wait-time-so-far for each hall call is stored and mapped against the direction of that hall call. Next, the car for which the objective function is being calculated is assumed to be assigned to the call being considered for reassignment in the master flow chart routine. Third, the remaining response time (RRT), predicted registration time (PRT), maximum predicted registration time (maxPRT), the RSR value, and average bunching measure (ABM) are calculated. The values for the five terms of the multi-term objective function are now calculated and summed for producing the multi-term objective function for use in the hall call assignment algorithm.

Figure 20:
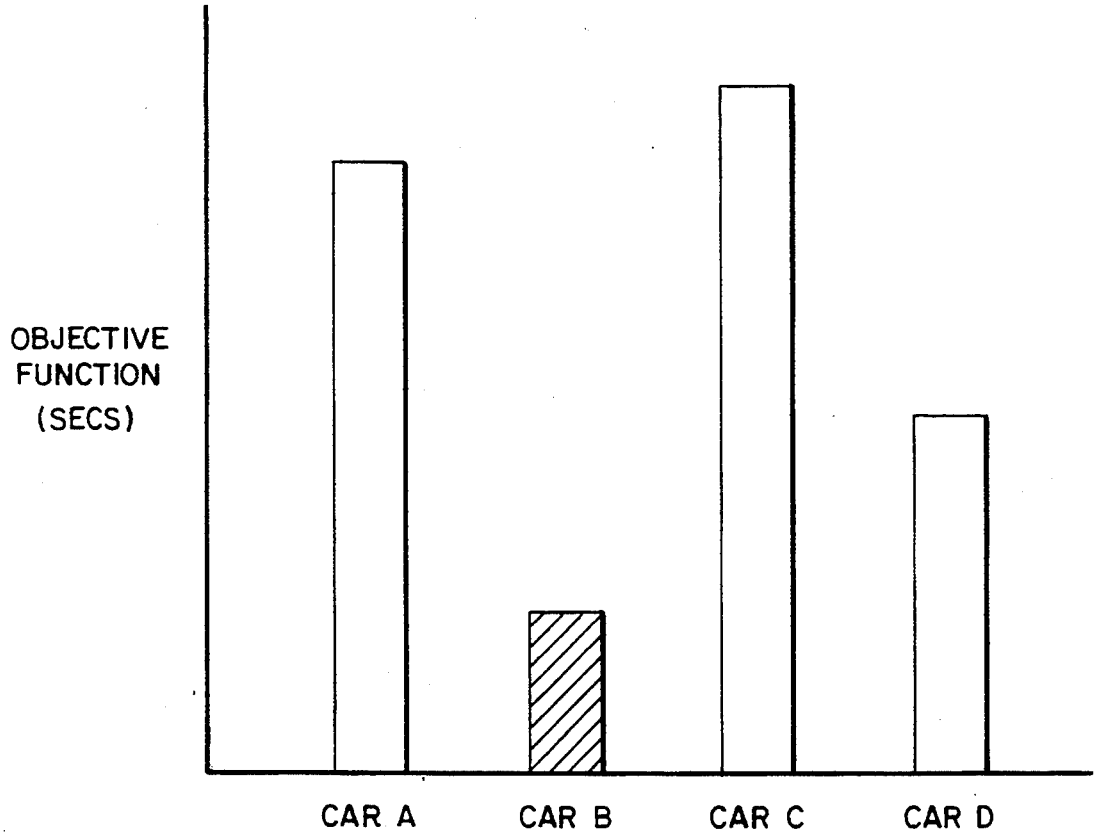
FIG. 20 is a graphical representation of an objective function with a single independent variable, showing the existence of a minimum value for the objective function.

FIG. 20 is a graph of the objective function of the cars in a bank; the car with the minimum value of the objective function (car B) is assigned to a hall call.

Various changes may be made without departing from the spirit and scope of the invention.

I claim:

1. A method of assigning a specific hall call to a selected one of a plurality of elevator cars operating as a group in a building, comprising:

(1) for each one of said cars in said group (a) tentatively assigning said specific hall call to said one of said cars;

(b) predicting the position in said building at which each one of said cars will be after each of a number of future time intervals if said specific hall call is assigned to said one car;

(c) determining the distance between the position of proximate cars, for each of the time intervals in step (b) wherein cars are proximate if (1) there is no car between them commanded to travel in the same direction or parked, and (2) there is no car between either of them and a terminal floor; and (d) calculating a bunching measure as a function of said distances determined in step (c);

(2) assigning said specific hall call to a selected one of said cars in a process utilizing said bunching measure; and (3) dispatching said selected car to respond to said specific hall call.

2. A method according to claim 1 wherein step (d) comprises determining said bunching measures as a function of the squares of the distances determined in step (c).

3. A method according to claim 1 wherein step (d) comprises determining said bunching measures as a function of the summation of the squares of the distances determined in step (c).

4. A method according to claim 1 wherein step (2) comprises providing, for each one of said cars, an objective function by combining said bunching measure for said one of said cars with another hall call assignment term related to the assignment of said specific hall call to said one of said cars.

5. A method according to claim 4 wherein step (2) comprises assigning said specific hall call to the one of said cars having the lowest objective function.

* * * * *